US005263917A

United States Patent [19]

Ybarra et al.

[11] Patent Number: 5,263,917

[45] Date of Patent: Nov. 23, 1993

[54] EXERCISE STRAP ARRANGEMENT

[76] Inventors: Lorenzo R. Ybarra, 14052 Rockenbach St., Baldwin Park, Calif. 91706; Robert A. Selva, 1279 Redwood View Dr., Phillips Ranch, Calif. 91766

[21] Appl. No.: 970,382

[22] Filed: Nov. 2, 1992

[51] Int. Cl.[5] ..... A63B 21/02

[52] U.S. Cl. ..... 482/126; 482/124; 482/131; 482/907; 482/125

[58] Field of Search ..... 482/124, 126, 131, 139, 482/907, 125; 16/111 R, 114 R, 114 B; 294/171

[56] References Cited

U.S. PATENT DOCUMENTS

| | | | |
|---|---|---|---|
| 480,618 | 8/1892 | Palmer | 294/171 |
| 1,633,124 | 6/1927 | Noe | 482/126 |
| 3,486,684 | 12/1969 | Dill et al. | 294/171 |
| 4,251,071 | 2/1981 | Norton | 482/125 |
| 4,722,523 | 2/1988 | Yang | 482/126 |
| 4,815,731 | 3/1989 | Suarez et al. | 482/124 |
| 4,911,434 | 3/1990 | Herring | 482/139 |

*Primary Examiner*—Richard J. Apley
*Assistant Examiner*—Lynne A. Reichard
*Attorney, Agent, or Firm*—Leon Gilden

[57] ABSTRACT

A plurality of leg straps are arranged for securement about an individual's legs to permit manual manipulation of the legs to enhance circulation for individuals lacking control of their lower limbs. The strap members include cooperative fastening surfaces for securement about the lower limbs, with each strap member having a top surface loop, with each top surface loop interconnected by a connecting belt. The connecting belt permits ease of manual manipulation upon grasping the belt and manipulation of each limb.

2 Claims, 4 Drawing Sheets

EXERCISE STRAP ARRANGEMENT

BACKGROUND OF THE INVENTION

1. Field of the Invention

The field of invention relates to therapeutic exercise apparatus, and more particularly pertains to a new and improved exercise strap arrangement wherein the same permits securement about an individual's limbs for manual manipulation of the limbs to enhance circulation therethrough.

2. Description of the Prior Art

Straps of various types for use in therapeutic arrangements such as in U.S. Pat. No. 4,844,094 to Grim have been utilized such as an ankle brace structure to effect wrapping and supporting of an ankle member of an individual.

U.S. Pat. No. 4,912,808 Blakely sets forth an assist strap for securement to a transport board of a vehicle body support plate.

U.S. Pat. No. 4,819,663 to Matre sets forth a leg restraint structure for a patient arranged to immobilize and secure a patient in a sitting position.

The instant invention attempts to overcome deficiencies of the prior art by setting forth an exercise strap arrangement wherein the same addresses both the shortcomings of the prior art by providing for a strap structure to permit manual manipulation of the lower limbs of an individual having, through disease or injury, lost effective use of the lower limbs and in this respect, the present invention substantially fulfills this need.

SUMMARY OF THE INVENTION

In view of the foregoing disadvantages inherent in the known types of therapeutic strap structure now present in the prior art, the present invention provides an exercise strap arrangement wherein the same is arranged to permit grasping and subsequent manual manipulation of the lower limbs of an individual. As such, the general purpose of the present invention, which will be described subsequently in greater detail, is to provide a new and improved exercise strap arrangement which has all the advantages of the prior art exercise strap apparatus and none of the disadvantages.

To attain this, the present invention provides a plurality of leg straps arranged for securement about an individual's legs to permit manual manipulation of the legs to enhance circulation for individuals lacking control of their lower limbs. The strap members include cooperative fastening surfaces for securement about the lower limbs, with each strap member having a top surface loop, with each top surface loop interconnected by a connecting belt. The connecting belt permits ease of manual manipulation upon grasping the belt and manipulation of each limb.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved exercise strap arrangement which has all the advantages of the prior art exercise strap apparatus and none of the disadvantages.

It is another object of the present invention to provide a new and improved exercise strap arrangement which may be easily and efficiently manufactured and marketed.

It is a further object of the present invention to provide a new and improved exercise strap arrangement which is of a durable and reliable construction.

An even further object of the present invention is to provide a new and improved exercise strap arrangement which is susceptible of a low cost of manufacture with regard to both materials and labor, and which accordingly is then susceptible of low prices of sale to the consuming public, thereby making such exercise strap arrangements economically available to the buying public.

Still yet another object of the present invention is to provide a new and improved exercise strap arrangement which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
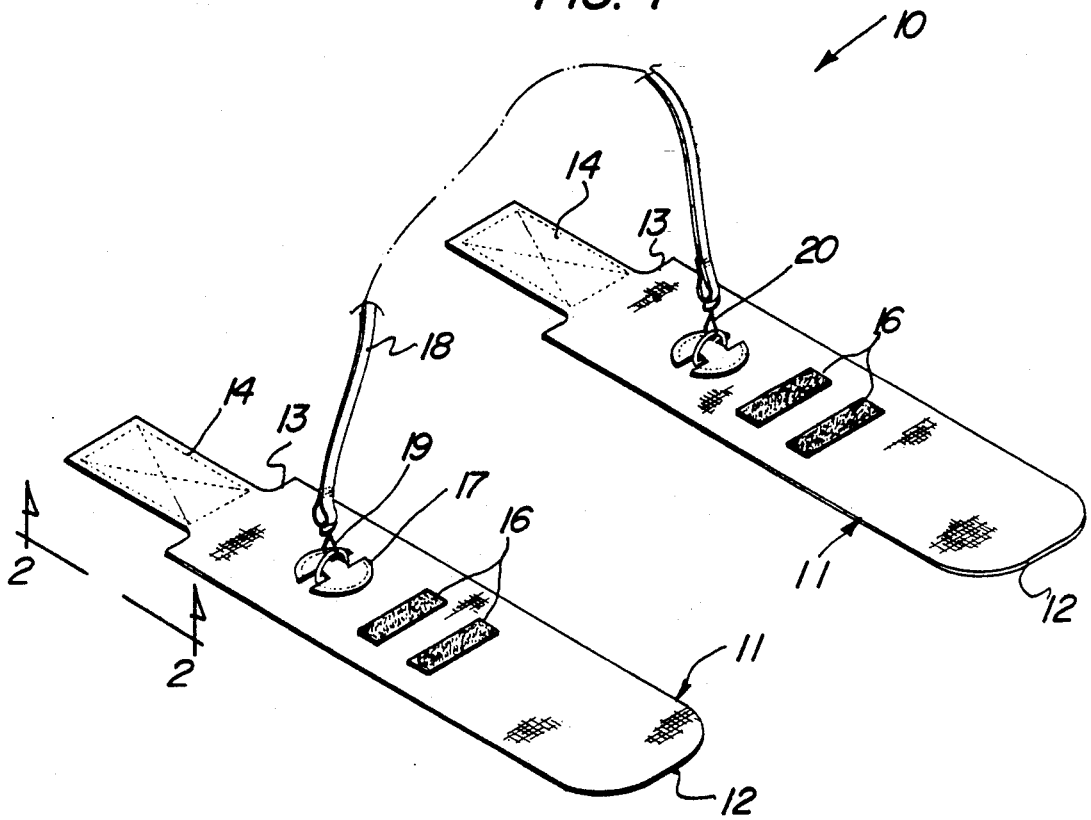
FIG. 1 is an isometric illustration of the invention.
Figure 2:
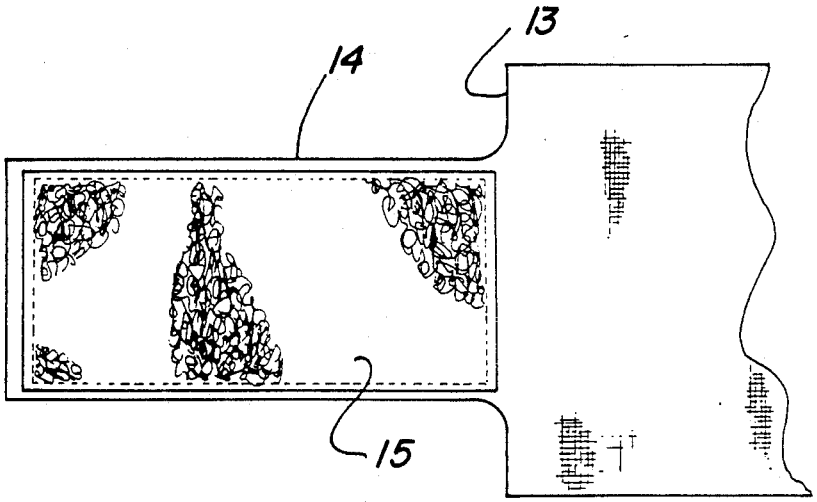
FIG. 2 is an orthographic view, taken along the lines 2—2 of FIG. 1 in the direction indicated by the arrows.
Figure 3:
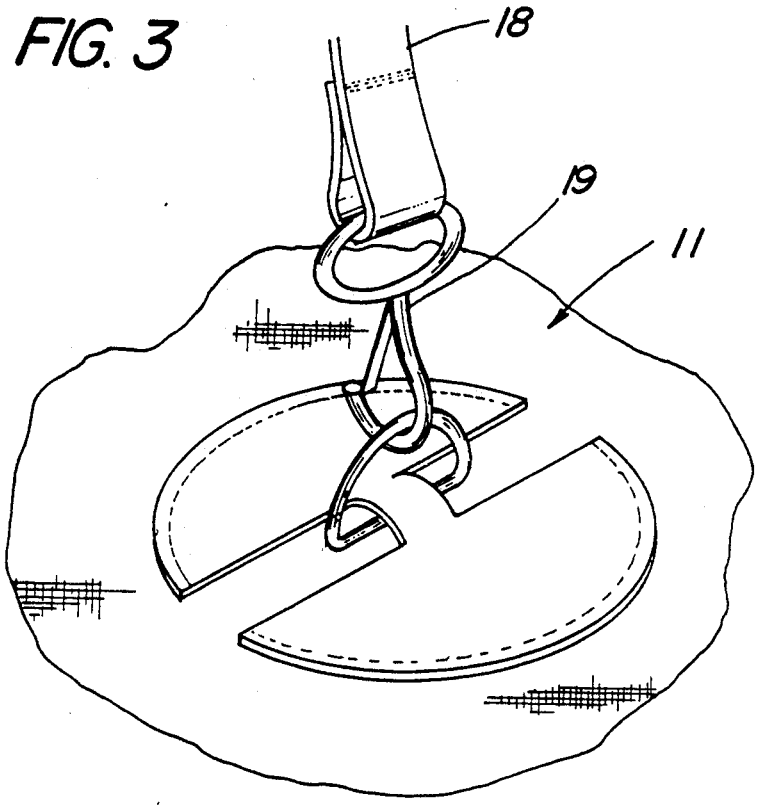
FIG. 3 is an isometric enlarged illustration of the connecting strap structure mounted to one of the strap members.

With reference now to the drawings, and in particular to FIGS. 1 to 8 thereof, a new and improved exercise strap arrangement embodying the principles and concepts of the present invention and generally designated by the reference numeral 10 will be described.

More specifically, the exercise strap arrangement 10 of the instant invention essentially comprises a plurality of leg straps 11, each having a first end spaced from a second end, with an extension web 14 projecting from the second end 13. The extension web 14 includes an extension web bottom surface having a first hook and loop fastener surface 15 positioned thereon. A plurality of second hook and loop parallel straps 16 are mounted to each top surface of each strap member 11 for cooperation with the first hook and loop fastener surface 15 to provide for encircling securement about an individual's leg. Each strap member 11 further includes a top surface loop 17 oriented between the second hook and loop strips 16 and the second end 13. A connecting belt 18 having a belt first end and a belt second end 19 and 20 respectively are mounted to the respective top surface loop 17 of each respective strap member 11. In this manner, manual grasping of the connecting belts 18 is available once the strap members 11 are secured about an individual's limbs to permit manual manipulation of an individual's limbs to enhance circulatory flow therethrough.

Figure 4:
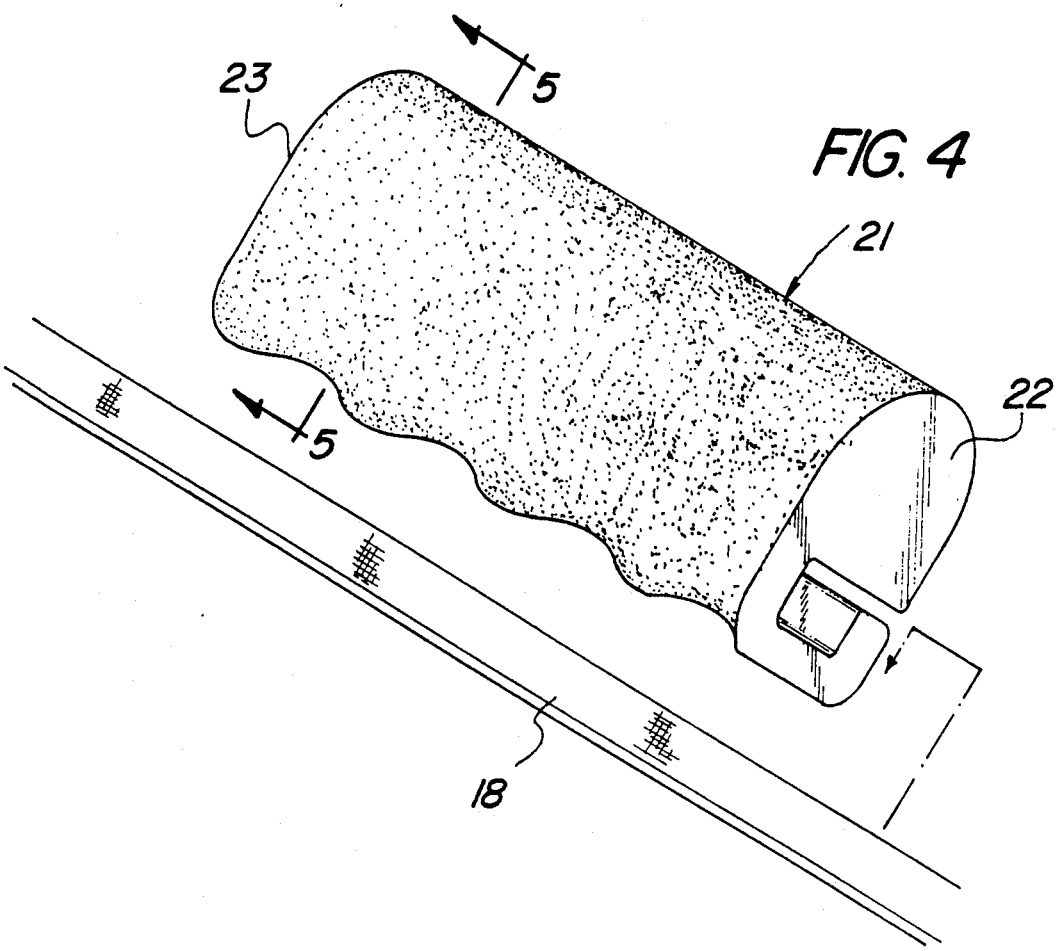
FIG. 4 is an isometric illustration of an accessory handle structure utilized by the invention.
Figure 5:
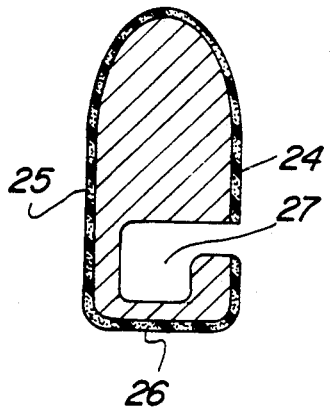
FIG. 5 is an orthographic view, taken along the lines 5—5 of FIG. 4 in the direction indicated by the arrows.

The FIG. 4 indicates the use of an auxiliary handle member 21 arranged for mounting to the connecting belt 18. The handle member 21 includes a first end wall 22 spaced from a second end wall 23. The handle member 21 further includes a first side wall 24 spaced from a second side wall 25, and a bottom wall 26 directed between the first and second side walls 24 and 25. An L-shaped groove 27 extends from the first side wall 24 towards the bottom wall 26, wherein the L-shaped groove 27 accordingly accommodates the connecting belt 18. In this manner, an enlarged grasping surface is provided and afforded in the manual manipulation of the connecting belt 18.

Figure 6:
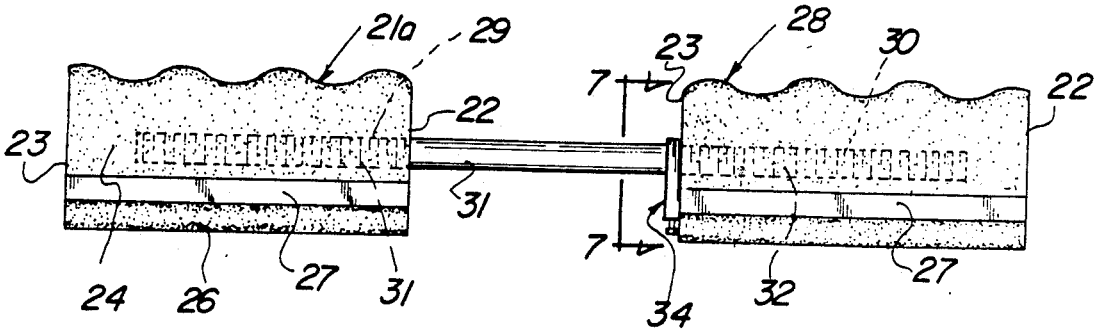
FIG. 6 is an orthographic view of a duality of handle members arranged for mounting to the strap structure to assist in manual manipulation of the strap structure.
Figure 7:
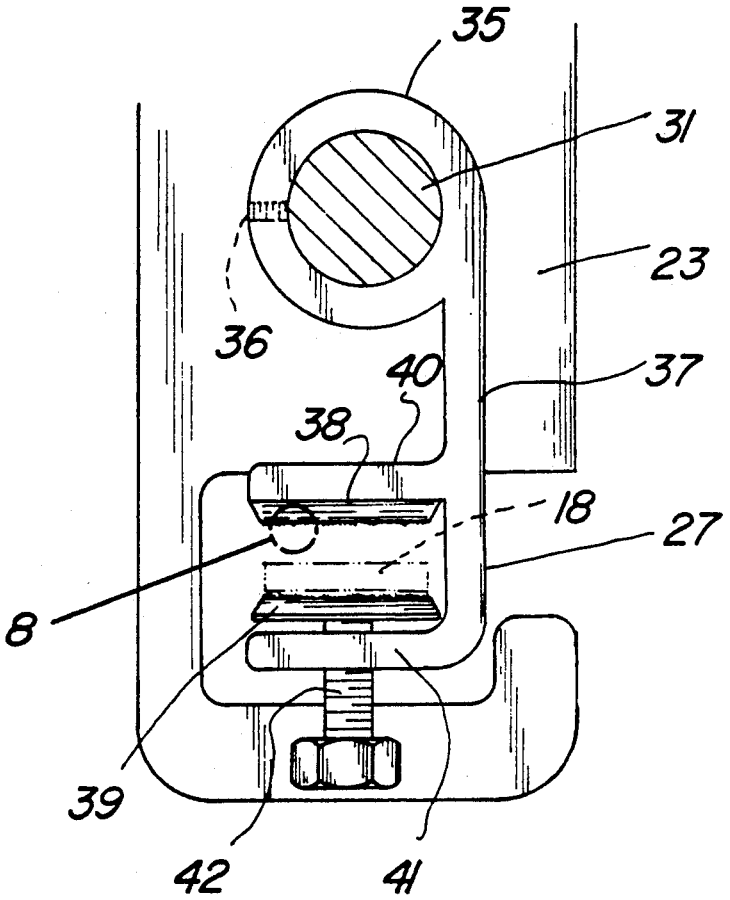
FIG. 7 is an orthographic view, taken along the lines 7—7 of FIG. 6 in the direction indicated by the arrows.
Figure 8:
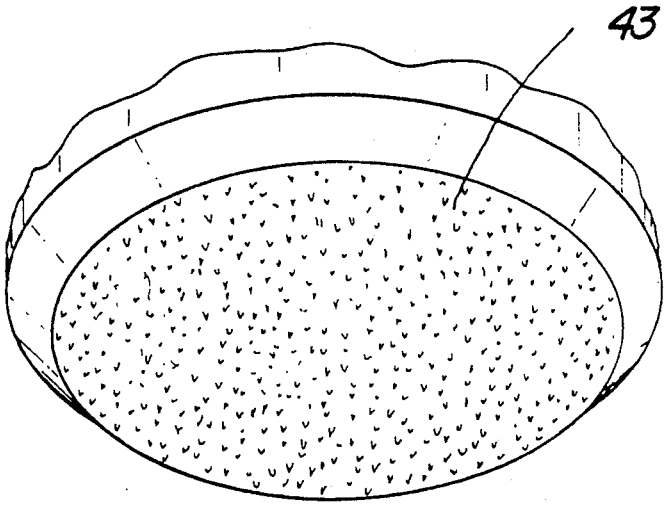
FIG. 8 is an enlarged isometric illustration of section 8, as set forth in FIG. 7.

Should a rigid grasping structure be desirable to permit dual manual grasping of a plurality of handles, the handle member 21 is configured as a modified handle member 21*a* cooperative with a second handle member 28, in a manner as indicated in FIG. 6. The modified handle member 21*a* includes a handle member threaded bore 29 directed therein oriented parallel relative to the L-shaped groove directed into the first end wall 22. The second end wall 23 of the second handle member 28 further includes a second handle member threaded bore 30. The handle member threaded bore 29 and the second handle member threaded bore 30 are coaxially aligned to receive the respective first and second respective threaded ends 32 and 33 of a rigid rod 31. In this manner, the handle members are secured together in aligned orientation. Further, each L-shaped groove of each of the handle members 21 and 28 are projecting to receive the flexible connecting belt 18. To insure that the flexible belt is maintained within the groove structure, a strap clamp 34 is provided secured to the rigid rod 31, in a manner as indicated in the FIGS. 6 and 7. Reference to FIG. 7 indicates that the strap clamp 34 includes a mounting cylinder 35 receiving the rigid rod 31 therethrough. A clamp fastener 36 is directed through the mounting cylinder 35 to engage the rigid rod for fixed positioning of the strap clamp 34 relative to the second handle member 28. A connecting web 37 projects downwardly relative to the mounting cylinder 35 tangentially oriented thereto, with first and second jaw plate webs 40 and 41 respectively oriented parallel relative to one another and orthogonally relative to the connecting web 37, with the first and second jaw plates 40 and 41 positioned below the mounting cylinder 35. The first jaw plate web 40 mounts a first jaw plate 38 fixedly thereto, with a second jaw plate 39 arranged in confronting and parallel relationship relative to the first jaw plate 38. The second jaw plate 39 is mounted to an interior end portion of an adjuster rod 40 that is threadedly directed through the second jaw plate web 41 orthogonally oriented relative to the second jaw plate web 41. In this manner, the confronting first and second jaw plates 38 and 39 (each including a matrix of strap projections 43) are arranged for confronting relationship relative to one another to fixedly secure the associated connecting belt 18 therebetween.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An exercise strap arrangement, comprising, a plurality of leg strap members, each leg strap member having a first end spaced from a second end, with each second end including an extension web projecting beyond the second end, and a first fastener mounted to a bottom surface of the extension web, and each strap member having a top surface, with each top surface having a second fastener, with the first fastener arranged for securement to the second fastener, and each strap member including a top surface loop mounted to each strap member between each second fastener and each second end, and a flexible connecting belt, the connecting belt having a connecting belt first end selectively securable to one of said strap members, and the connecting belt having a connecting belt second end, with the connecting belt second end arranged for securement to a further said strap member to secure the first strap member to the second strap member to permit manipulation of the strap members, and at least one handle member, the handle member having a first end wall spaced from a second end wall, and a first side wall spaced from a second side wall, and a bottom wall directed between the first side wall and the second side wall, and an L-shaped groove directed into the handle member having a groove first leg extending to the second side wall and a groove second leg extending to the bottom wall, wherein the L-shaped groove is arranged to receive the connecting belt therewithin, and a further handle member, the further handle member having a further handle member first end wall spaced from a further handle member second end wall, and a further handle member first side wall spaced from a further handle member second side wall, and a further handle member bottom wall, and a further L-shaped groove directed into the further handle member from the first side wall towards the further handle member bottom wall, and the handle member first end wall including a handle member threaded bore, and the further handle member second side wall including a further handle member threaded bore, wherein the handle member threaded bore and the further handle member threaded bore are coaxially aligned, and a rigid rod having a rigid rod first threaded end directed into the handle member threaded bore, and a rigid rod second threaded end directed into the further handle member threaded bore, and a strap clamp, with the strap clamp having a mounting cylinder receiving the rigid rod therethrough in adjacency to the further handle member second side wall, and the mounting cylinder having a clamp fastener directed through the mounting cylinder into contiguous communication with the rigid rod, the mounting cylinder having a connecting web tangentially and fixedly mounted to the mounting cylinder extending from the mounting cylinder, and including a first jaw plate web and a second jaw plate web that are parallel relative to one another and orthogonally mounted to the connecting web in a spaced relationship, the first jaw web having a first jaw plate mounted thereto, and the second jaw plate web including an adjuster rod orthogonally and threadedly directed through the second jaw plate web, with the second jaw plate web including a second jaw plate fixedly and orthogonally mounted to the adjuster rod between the first jaw plate and the second jaw plate web, and the first jaw plate and the jaw plate arranged parallel relative to one another in a confronting relationship.

2. An exercise strap arrangement as set forth in claim 1 wherein the first jaw plate and the second jaw plate each include a matrix of strap projections arranged to engage the connecting belt.

* * * * *